US005857259A

United States Patent [19]

Johnston

[11] Patent Number: 5,857,259

[45] Date of Patent: Jan. 12, 1999

[54] METHOD FOR MAKING AN ELECTRICAL CONNECTION

[75] Inventor: James J. Johnston, Newington, Conn.

[73] Assignee: The Wiremold Company, West Hartford, Conn.

[21] Appl. No.: 393,843

[22] Filed: Feb. 24, 1995

[51] Int. Cl.[6] ..... H01R 43/00

[52] U.S. Cl. ..... 29/858; 29/861; 29/871; 29/872; 29/878; 174/76; 228/110.1; 439/492; 439/736

[58] Field of Search ..... 24/857, 858, 861, 24/863, 872; 174/84, 72 A, 76, 77 R, 90–94 R; 29/871, 878; 156/73.2; 439/492, 494, 495, 499, 736, 874; 228/110.1

[56] References Cited

U.S. PATENT DOCUMENTS

| | | | |
|---|---|---|---|
| 3,184,354 | 5/1965 | Strother | 156/73.2 |
| 4,614,028 | 9/1986 | Rich | 29/857 |
| 5,114,362 | 5/1992 | Olsson | 29/857 |
| 5,134,249 | 7/1992 | Adachi | 174/92 |
| 5,475,921 | 12/1995 | Johnston | 29/878 |

*Primary Examiner*—P. W. Echols
*Attorney, Agent, or Firm*—McCormick, Paulding & Huber

[57] ABSTRACT

A high density electrical termination assembly made by forming a terminal assembly including separate thermoplastic sections having confronting surfaces. An in-line array of conductor receiving slots open through the confronting surface of one of the sections and a plurality of elongate spaced apart energy directors project from and extending along the confronting surface of the other of the sections. Stacking within the grooves portions of the conductors to be connected are stacked within slots in the terminal section. The thermoplastic sections positioned in juxtaposed stacked relationship to each other along the confronting surfaces with the energy directors extending across the slots in axially transverse relationship to the conductors stacked within the slots. Compressive force applied to the thermoplastic sections urge the confronting surfaces toward engagement with each other and cause the energy directors to apply compressive force at axially spaced apart locations to the conductors stacked within the slots. High frequency vibratory energy applied to the sections while the sections are maintained under compression softens the thermoplastic energy directors and the thermoplastic surfaces engaged by the energy directors providing molten thermoplastic material at the interface between the sections. The application of high frequency vibratory energy cases while the sections are maintained under compression.

35 Claims, 4 Drawing Sheets

METHOD FOR MAKING AN ELECTRICAL CONNECTION

BACKGROUND OF THE INVENTION

This invention relates in general to electrical connections and methods for making such connections and deals more specifically with improved connections and connecting methods particularly adapted for use where high density termination is required.

The employment of soldering and welding techniques for termination of wire conductors and more recently for the termination of high density connectors has come full circle over the past five decades. Soldered and welded terminations, when perfectly executed, represent the optimum of electrical junctions achievable between two metallic materials. Both technologies avoid the use of a third formed metal member required for crimp termination, a special slotted contact member utilized in insulation displacement termination or a stable square post employed in wire wrap termination. These popular options to soldered and welded connections seriously limit the degree of architectural density (contact spacing) achievable with soldering and welding.

Serious disadvantages associated with soldering or welding as a conductor termination method include the use of toxic materials, such as lead, the relatively low production rates associated with manual termination by these methods and the high cost of such automated production equipment. Further, soldered and welded electrical connections afford low resistance to shock and vibration and often lack reliability due to the formation of "cold joints" that are virtually undetectable.

The presently dilemma of employing soldered or welded terminations to facilitate high density electronic packaging is further complicated by established criteria for the use of stranded and solid conductors. During the pre-crimp era of the early 1940's when soldering and welding were the only practical termination options it was generally accepted that soldering was the proper choice for stranded and welding for solid conductor constructions. Subsequent advancements in crimp technology offered viable alternatives for terminating both types of conductors for many industrial, power and electronic applications. However, new design criteria, primarily high density construction, again necessitated choice between solid or stranded wire interconnect options. Since conventional crimp type terminals were not ideally suited for high density termination of wires to connectors, it became evident that a new generation of termination technology would be required to serve the rapid expansion of industry into the computer age of the 1960's.

Two popular technologies emerged. Wire wrap termination, which consists of wrapping a solid small gauge conductor around a sharp cornered post, dominated for about 20 years. A stranded wire technique, which competed for this market, employs a spring terminal applied to the post to trap the stranded wire conductor between the post and terminal in gas-tight relationship.

The aforesaid advancements were accompanied by the creation of the insulation displacement type connector (IDC) to facilitate termination of wire conductors without the need for stripping the dielectric (jacket) prior to engagement to the contact terminal. Although occasionally utilized for stranded wire with special provisions, this method is generally accepted only for solid wire termination and, in fact, many large manufacturers prohibit the use of IDC technology for applications where high shock and vibration is likely to be encountered. IDC termination also limits contact spacing or density and where increased density is required staggered multiple rows of contacts must generally be employed with a single termination at each contact position.

Although recent developments in electronic packaging include use of multi-layer printed circuit boards and massive large scale integration (chips) to condense enormous amounts of circuitry, present IDC technology continues to serve these units with input and output power and signals. Now with even more density required to support the next move to microelectronics it has again become desirous to employ solder terminated stranded wire to achieve the flexing reliability required.

Accordingly, it is the general aim of the present invention to provide an improved solderless electrical connection and connecting method which is particularly suitable for use in the high density connection and/or mass termination of electrical conductors. It is a still further aim of the invention to provide improved electrical connections and connecting methods suitable for high production at low cost and having electrically conductive integrity equal or superior to other comparable connections produced by presently available methods.

SUMMARY OF THE INVENTION

An electrical connection made by forming a terminal assembly including thermoplastic sections having confronting surfaces. A conductor receiving slot opens outwardly through the confronting surface of one of the sections and elongate spaced apart energy directors project from and extend along the confronting surface of the other of the sections. Axially extending portions of conductors to be connected and including an outermost portion are stacked in electrically contacting engagement within the slot after which the thermoplastic sections are arranged in juxtaposed stacked relation to each other along the confronting surfaces with the energy directors bridging the slot and extending across the and engaging the axially extending outermost portion. Compressive force applied to the thermoplastic sections urge the confronting surfaces toward engagement with each other and cause the energy directors to bear upon the outermost portion of the stack of conductors within the slot. High frequency vibratory energy applied to the sections melts of the thermoplastic energy directors and the thermoplastic surfaces engaged by the energy directors to provide molten thermoplastic material at the interface between the sections and in the region of the slots while the sections are maintained under compression. Application of high frequency vibratory energy is ceased while the sections are maintained under compression allowing the molten thermoplastic material to solidify to form a weld joining the thermoplastic sections in assembly and encapsulating in thermoplastic material axially extending portions in electrically contacting engagement with each other.

DETAILED DESCRIPTION OF PREFERRED METHOD AND EMBODIMENT

Figure 1:
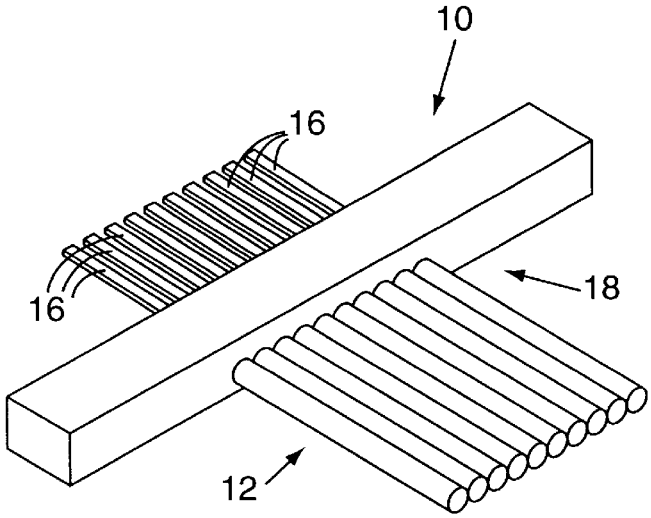
FIG. 1 is a fragmentary perspective view of an electrical connection assembly made in accordance with the present invention.
Figure 2:
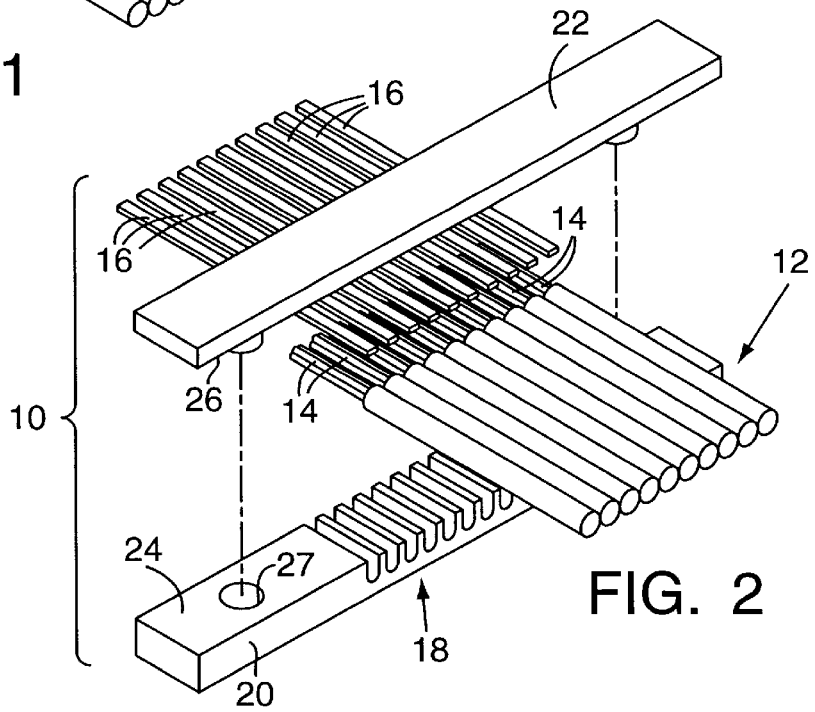
FIG. 2 is an exploded fragmentary perspective view of the elements which comprise the electrical connection of FIG. 1.
Figure 3:
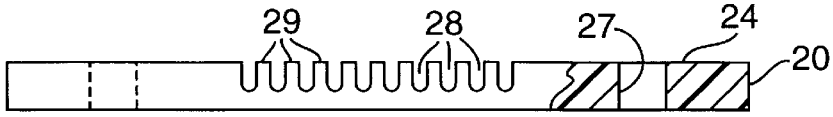
FIG. 3 is a somewhat enlarged side elevational view of the terminal section which comprises a part of the electrical connection assembly of FIG. 1.
Figure 4:
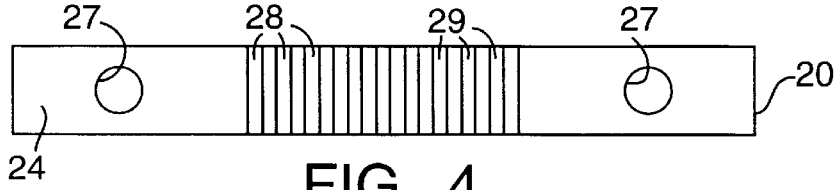
FIG. 4 is a top plan view of the terminal section.

In the drawings and in the description which follows the present invention is illustrated and described with reference to a high density array or assembly of electrical connections made in accordance with the invention and indicated generally by the reference numeral 10 however, it should be understood that the methods hereinafter described may also be employed to make a single electrical connection. The illustrated assembly 10 essentially comprises a flat ribbon cable, designated generally by the reference numeral 12, which includes an in-line array of closely spaced individually insulated stranded wire conductors 14, 14. A bare or exposed portion of each stranded wire conductor 14 is electrically connected to an associated solid conductor 16 which may, for example, comprise a terminal end of a spring wire contact on an associated electronic component such as a modular telecommunication connector (not shown). The conductors 14,14 and 16,16 are secured in electrically contacting engagement by a terminal assembly indicated generally at 18 made from a suitable dielectric thermoplastic material and formed by separate sections joined in assembly by application of pressure and high frequency vibratory energy, in a manner hereinafter further described.

The electrical terminal assembly used in practicing the invention may take various forms and may, for example, comprise an integral part of another component, as, for example, a part of a modular telecommunication connector. However, the illustrated terminal assembly, indicated generally at 18, comprises an elongate generally rectangular terminal strip formed by mating sections of amorphous or semi-crystalline thermoplastic material and includes a generally rectangular terminal section 20 and a generally rectangular cap section 22.

As shown oriented in the drawings, the lower or terminal section 20 and the upper or cap section 22 respectively define confronting upper and lower surfaces indicated at 24 and 26. The terminal section 20 has a pair of longitudinally spaced apart apertures 27, 27 near its ends which open upwardly through the surface 24, for a purpose which will be hereinafter evident. A longitudinally extending in-line array or series of parallel slots 28, 28 separated by barriers 29, 29 are formed in the terminal section 20, extend transversely through it and open upwardly through the upper surface 24 as shown in FIGS. 2–5. The number of slots may vary and will be determined by the number of individual connections or terminations to be formed. However, the illustrated terminal section 20 has ten slots.

Figure 5:
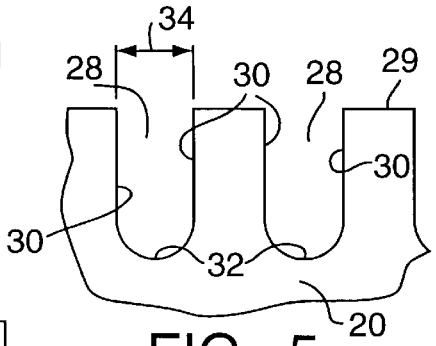
FIG. 5 is a somewhat further enlarged fragmentary side elevational view similar to FIG. 3.

A typical slot 28, shown in FIG. 5, has opposing parallel sidewalls 30, 30 and a bottom or inner end wall 32 shaped to substantially complement an associated portion of a conductor received therein. The illustrated terminal section 20 is particularly adapted to receive conventional flexible seven strand soft copper wire conductors 14, 14 of generally circular cross-section, and which may be plated with precious metal, therefore, the inner end 32 is substantially semi-cylindrical to generally complement the cross-sectional configuration of the associated portion of the conductor 14. The width dimension of each slot 28, indicated by the numeral 34 in FIG. 5, is substantially equal to or slightly greater than the nominal diameter of the associated stranded wire conductor 14.

The depth of the slot 28 is predetermined by physical characteristics and dimensions of the portion of the conductor or conductors to be received therein. Thus, for example, where at least one of the conductors is an axially elongate stranded soft copper wire conductor, such as the seven strand conductor 14, which undergoes significant physical and cross-section dimensional change when subjected to a radially directed compressive force within the range contemplated by the method of the present invention, this factor must be considered in determining the required slot depth. This change in cross-sectional dimension produced by application of a force of known magnitude, hereinafter referred to as the compressibility factor, is determined for at least one of the particular conductors to be joined and is employed in determining the optimum depth dimension of the slot 28.

Figure 9:
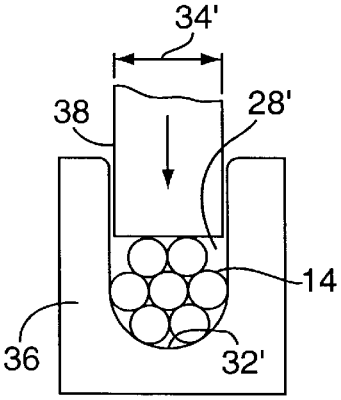
FIG. 9 is a somewhat schematic view of a testing apparatus for determining the compressibility factor of a conductor.
Figure 11:
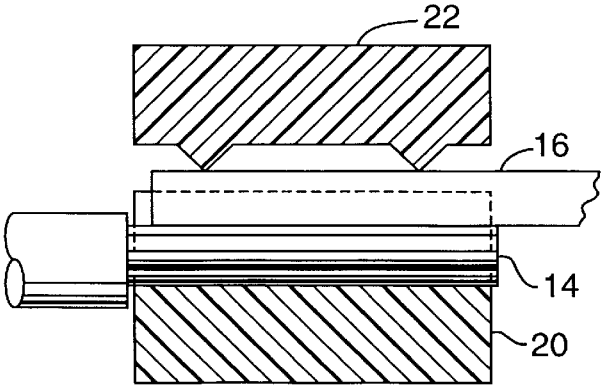
FIG. 11 is a fragmentary sectional view taken along the line 11—11 of FIG. 10.
Figure 13:
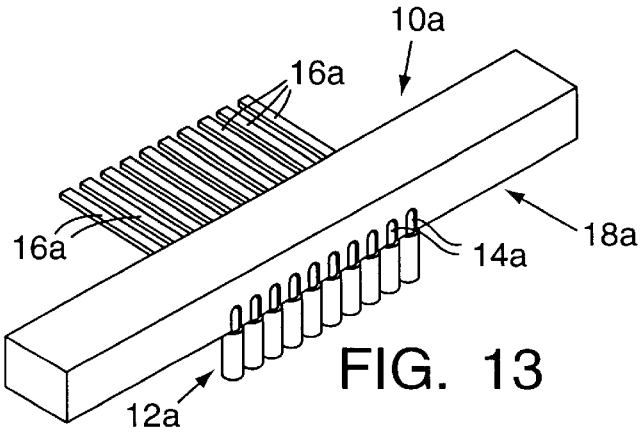
FIG. 13 is similar to FIG. 1 but shows another electrical connection assembly.
Figure 16:
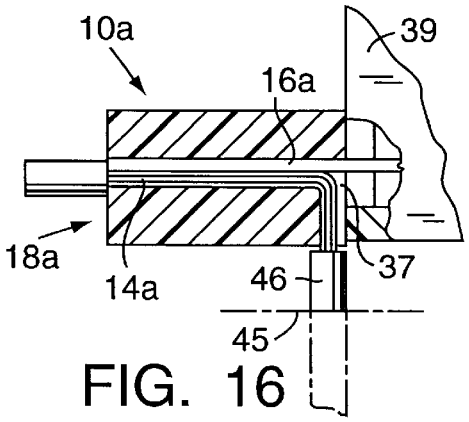
FIG. 16 is a fragmentary side elevational view shown partially in section and shows the assembly of FIG. 13 in connected relation to another electronic component.
Figure 14:
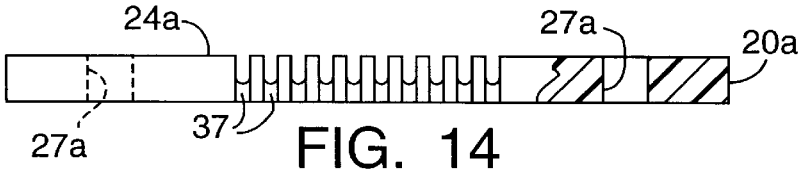
FIG. 14 is a somewhat enlarged side elevational view of the terminal section which comprises a part of the assembly shown in FIG. 13.
Figure 15:
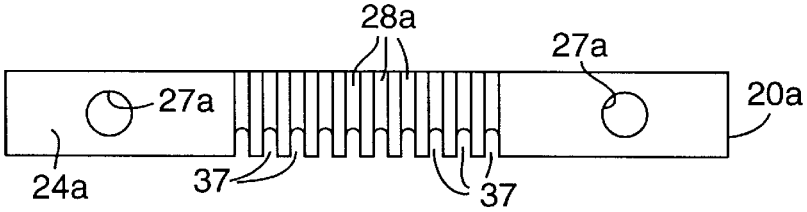
FIG. 15 is a top plan view of the terminal section shown in FIG. 14.

Referring now to FIG. 9, the compressibility factor for the conductor 14 may, for example, be determined by providing a test material 36 having a test slot 28' similar to the slot 28 shown in FIG. 5, a width dimension 34' substantially corresponding to the nominal cross-sectional dimension of the stranded wire conductor 14 and a bottom or inner end wall 32' which complements an associated lower portion of the conductor 14, substantially as shown. A downwardly directed force of a magnitude within the anticipated range to be employed in assembling the electrical connection 10 is applied to the conductor 14 by a ram 38 slidably received within the slot 28' and having a lower bearing surface for engaging the conductor 14 within the slot 28'. The resulting compressibility factor, which may be expressed as a percentage change in the nominal cross-sectional dimension of the stranded wire conductor 14 measured in the direction of the applied force in response to a force of known magnitude may then be utilized to determine the required depth dimension of the slot 28.

It is contemplated that the force applied to the sections 20 and 22 during assembly will be at least four pounds but will not exceed eleven pounds, five pounds being the presently preferred assembly force. It has been found that a test force of about five pounds applied to the stranded wire conductor 14 in the manner generally aforedescribed yields a compressibility factor of about twenty five percent. Thus, the depth of the slot 28 should be equal to the height of the stacked conductors 14 and 16 within the slot less twenty five percent of the nominal diameter of the stranded wire conductor 14.

The compressibility of the relatively hard spring wire conductor 16 is substantially negligible as compared to that of the softer compressible stranded wire conductor 14. Current results indicate that a most satisfactory junction can be formed considering only the compressibility factor for the softer more readily compressible stranded wire component in determining the required depth dimension of the slot 28.

It should now be apparent that when the invention is practiced with other relatively compressible conductors, as, for example, nineteen strand soft stranded copper wire conductors, appropriate consideration of the compressibility factor will be essential to proper design of the terminal section.

Figure 6:
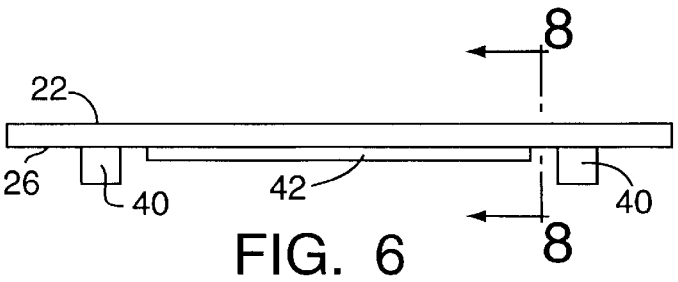
FIG. 6 is a somewhat enlarged side elevational view of the cap section which comprises a part of the electrical connection of FIG. 1.
Figure 7:
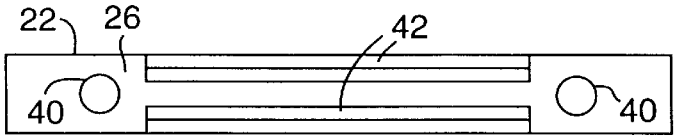
FIG. 7 is a bottom plan view of the cap section.
Figure 8:
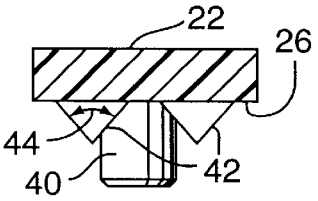
FIG. 8 is a somewhat further enlarged fragmentary sectional view taken along the line 8—8 of FIG. 6.

The cap section 22, best shown in FIGS. 6–8, is adapted for mating engagement with the terminal section 20 and includes a pair of integral dowels or guide posts 40, 40 which project downwardly from the lower surface 26 for complementary registry with the apertures 27, 27 to align the cap section 22 with the terminal section 20 with the confronting surfaces 24 and 26 in general registry with each other when the two sections 20 and 22 are assembled in stacked juxtaposed relationship to each other.

A plurality of elongate transversely spaced apart energy directors 42, 42 project from and extend longitudinally along the cap surface 26, substantially as shown. The cross-sectional configurations of the energy directors may vary. However, the presently preferred energy directors used in forming the illustrated assembly 10 have a triangular cross-section and an apex forming an included angle of about 90 degrees. The apex angle of a typical energy director is shown in FIG. 8 and indicated generally by the reference numeral 44.

Figure 10:
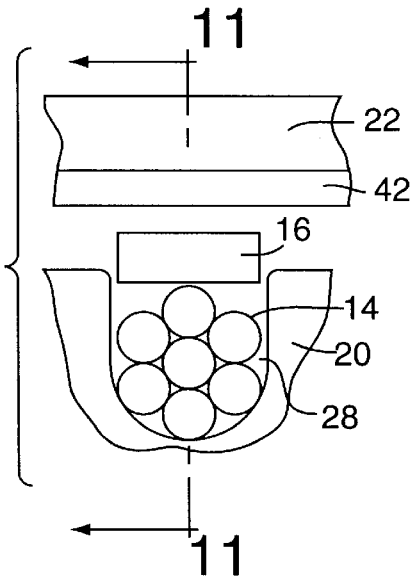
FIG. 10 is a somewhat enlarged fragmentary side elevational view and shows the connection of FIG. 1 in an initial stage of assembly.
Figure 12:
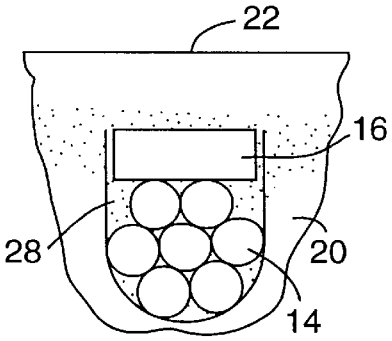
FIG. 12 is similar to FIG. 9 but shows the final stage of assembly.

Preparatory to forming the electrical connection assembly 10 insulation is stripped from the ribbon cable 12 to expose portions of the conductors 14,14 for connection. In the illustrated electrical connection assembly end portions of the conductors 14,14 which comprise the ribbon cable 12 are electrically connected to associated end portions of solid wire conductors 16, 16, which may comprise the contacts on an associated electronic component. Consequently, part of the insulation jacket is stripped from one end portion of the ribbon cable 12, substantially as shown. The exposed bare end portions of the individual conductors 14, 14 are then positioned within the slots 28, 28. More specifically, an exposed end portion of each stranded conductor 14 is positioned within the inner end 32 of an associated slot 28. After all of the conductors 14, 14 have been properly positioned within the slots 28, 28, the solid wire conductors 16, 16 are positioned within associated slots in stacked relation to and in electrical contacting engagement or the axially extending portions of conductors 14, 14 to form stacks, substantially as shown in FIG. 10. After these initial steps of assembly have been performed each outmost conductor 16 extends for some distance above and outwardly beyond the terminal section surface 24, substantially as shown in FIG. 10.

Thereafter, the sections 20 and 22 are arranged in juxtaposed stacked relation to each other with the guide posts 40, 40 on the cap section 22 disposed within the apertures 27, 27 in the terminal section 20. It will be noted that the energy directors 42, 42 bridge the slots 28, 28 and extend across and engage the outermost portions of the conductors 16, 16 disposed within the slots 28, 28.

Compressive force applied to the thermoplastic sections 20 and 22 urges the confronting surfaces 24 and 26 toward engagement with each other and compresses the stacked conductors 14, 14 and 16, 16 within the slots 28, 28. As previously noted, the stranded wire conductors 14, 14 when arranged within slots 28, 28, as hereinbefore described, are found to have a compressibility factor of about twenty five percent when subjected to a compressive force of about five pounds. Thus, when a downwardly directed force of about five pounds is applied to the cap section 20 to move it toward the terminal section and to bring the confronting surfaces 24 and 26 into engagement the energy directors 42, 42 engage axially spaced apart portions of the solid conductors 16, 16. Force is transmitted by the solid conductors 16, 16 to the stranded wire conductors 14, 14 causing some of the individual strands which comprise each of the stranded wire conductors 14, 14 to be displaced relative to each other within the slots 28, 28 resulting in some cross-sectional deformation accompanied by an approximately twenty five percent reduction in the height dimension of each conductor 14 measured in the direction of applied force. Some of the individual soft wire strands which comprise the conductors 14, 14, and particularly those strands in contact with the hard wire conductors 16, 16, may undergo slight deformation or flattening thereby increasing in the area of contact between the solid and stranded wire conductors. This condition is generally desirable and tends to lessen the electrical resistance at the connection between the conductors thereby improving electrical conductivity through the junction.

While the sections 20 and 22 are maintained in compression, high frequency vibratory energy is applied to the sections to soften the thermoplastic energy directors 42, 42, and associated portions of the confronting surfaces 24 and 26 to provide molten thermoplastic material at the interface between the terminal sections 20 and 22. Application of high frequency vibratory energy ceases while the sections are maintained in compression allowing the molten thermoplastic material at the interface to solidify forming a weld joining the thermoplastic sections resulting in an integral terminal strip which at least partially encapsulates coengaging portions of the conductors 14, 14 and 16, 16.

In accordance with the presently preferred method of practicing the invention, one of the sections 20, 22 is supported within a suitable fixture mounted on an ultrasonic welding machine while compressive force is applied to the other of the sections by the horn of the welding machine which also applies ultrasonic vibratory energy to the sections to weld the sections 20 and 22 together at the interface defined by the confronting surfaces 24 and 26.

The ultrasonic welding operation also causes portions of the energy directors which bridge the slots 28, 28 to melt in the regions of the slots. This molten material flows into and is redistributed within the slots 28, 28 filling voids therein, thereby producing at least some hermetic sealing of areas of contact between the associated conductors 16, 16 and 14, 14 which prevents corrosion in these regions of contact and aids in preserving the integrity of the resulting electrical connections.

In multi-position high density applications, such as aforedescribed the standard spacings or center distances between adjacent terminal slots are 0.050, 0.025 and 0.0125. The slot width for such multi-position high density applications is limited by the slot to barrier ratio for a particularly spacing. The width or diameter of the conductors to be joined must fall within this parameter. A desired groove spacing of 0.0125 in., for example, utilizing an AWG No. 32 solid wire conductor (0.008 in. dia.) would dictate a slot to barrier ratio of 0.64/0.36 percent or 0.008/0.0045 in. However, this slot to barrier ratio puts the barrier on the technical edge. A more suitable alternative may be to use an AWG No. 34 wire (0.0065 in. dia.) yielding a slot to barrier dimension of 0.0065/0.006. The slot width must control and limit lateral expansion of the conductor materials to be compressed therein and should be held to exactly or slightly less than the nominal diameter of the wire when stranded wire is used and exactly or slightly more than the width or diameter where solid wire is employed.

Proper slot depth is critical to ensure proper termination. Each application must be analyzed and evaluated in terms of the compressibility factor for each bare metal conductor to be terminated. The slot depth must be equal to the combined height of the stacked conductors within the groove after compression or deformation of these conductors, (i.e. after assembly).

Soft flexible fine stranded wire conductors, such as aforediscussed, have a tendency to fray when stripped at the ends which makes it difficult in properly positioning the stripped ends of such conductors within the associated minute slots in the terminal section. This problem is overcome by stripping the insulation from a conductor in spaced relation to its end so that at least a band of insulation remains on the end portion of the conductor to prevent fraying or separation of the individual strands which comprise the conductor. A modified electrical connection assembly which aids in overcoming the aforedescribed problem is illustrated in FIGS. 13–16 and indicated generally at 10*a*. The illustrated connection assembly 10*a* includes a terminal assembly indicated generally at 18*a* and similar in most respects to the terminal assembly 10 previously described. However, the illustrated assembly 10*a* differs from the previously described assembly in that the terminal section 20*a* has a plurality of exit grooves 37, 37 equal in number to the conductor receiving slots 28*a*, 28*a*. Each exit grooves 37 formed within the section 20*a* opens outwardly through an end wall and the bottom wall of the section and communicates with an associated wire receiving slot 28*a*. Preferably, and as shown, the exit grooves 37, 37 are formed in normal relation or at right angles relative to the wire receiving slots 28*a*, 28*a*. When the ribbon cable 12*a* is prepared for connection to the terminal ends or tabs on the contacts of an associated electrical component the insulation is stripped from the cable to expose a sufficient length of each bare wire conductor so that it may be positioned within both a conductor receiving slot 28*a* and an exit groove 37 formed in the terminal section 20*a*. The exposed portions of the individual stranded wire conductors are next positioned within the inner end portions of the conductor receiving slots 28*a*, 28*a* with the insulated end portion of the cable extending beyond the end wall of the terminal section. After the stranded wire conductors have been properly positioned within associated wire receiving slots the insulated extending end portion of the cable is then bent downwardly to position exposed portions of the conductors within the exit grooves 37, 37. This arrangement allows the lower section 20*a* to be brought into close relationship to and, if necessary to be positioned immediately adjacent an associated electronic component such as a modular telecommunication jack, shown in FIG. 16 and indicated by the numeral 39, which contains the hard wire conductors 16*a*, 16*a*. The free end portion of the ribbon cable 12*a* is sheared close to the terminal section, as, for example, along a shear line indicated at 45 leaving a band of insulating material 46 on the free end of the cable 12*a* to control free ends of the individual strands.

Figure 17:
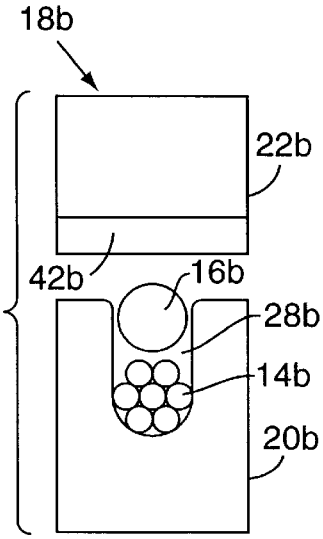
FIG. 17 illustrates step in a method for connecting a solid conductor and a stranded conductor.

The method of the invention hereinbefore generally described may also be employed to form connections between other conductor combinations and in FIG. 17 there is illustrated a step in a method for forming a single electrical junction between a solid wire conductor of circular cross-section and a stranded wire conductor respectively indicated at 14*b* and 16*b*. A terminal assembly 18*b* is employed and includes a terminal section 20*b* and a cap section 22*b*. Preparatory to assembly, the conductors are stacked within a single slot 28*b* formed in the terminal section 20*b* slot 28*b* with the stranded wire conductor positioned within the inner ends of the slots 28*b*. In accordance with presently preferred practice, if one of the conductors is more readily compressible than the other the more readily compressible conductor is positioned within the inner end of the slot. Since the compressibility of the solid conductor 16*b* is substantially negligible as compared with that of the stranded conductor 14*b* it is only necessary to consider the compressibility factor of the stranded conductor in determining the required depth of the slot 28*b*. The cap section 20*b* which carries spaced apart energy directors 42*b*, 42*b* (one shown) which bridge the slot 28*b* is brought into compressing engagement with the stacked conductors 16*b* and 14*b* and is ultrasonically welded to the terminal section 20*b* as hereinbefore generally described.

Figure 18:
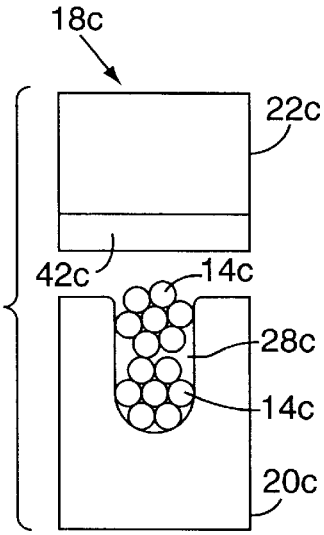
FIG. 18 illustrates a step in a method for joining stranded conductors.

FIG. 18 illustrates a step in a method for connecting associated portions of two substantially identical stranded conductors 14*c*, 14*c*. When two such substantially identical stranded conductors are to be connected it is necessary to determine and apply the compressibility factor for both of the conductors in determining the required depth of the conductor receiving slot. However, if the stranded conductors are not identical and have differing compressibility factors, the more readily compressible conductor should be positioned in the inner end of the conductor receiving slot.

Figure 19:
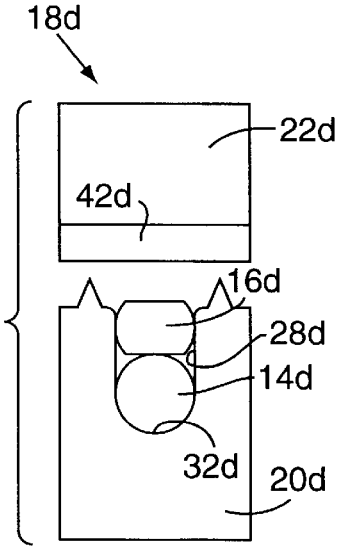
FIG. 19 illustrates a step in a method for connecting solid conductors.
Figure 20:
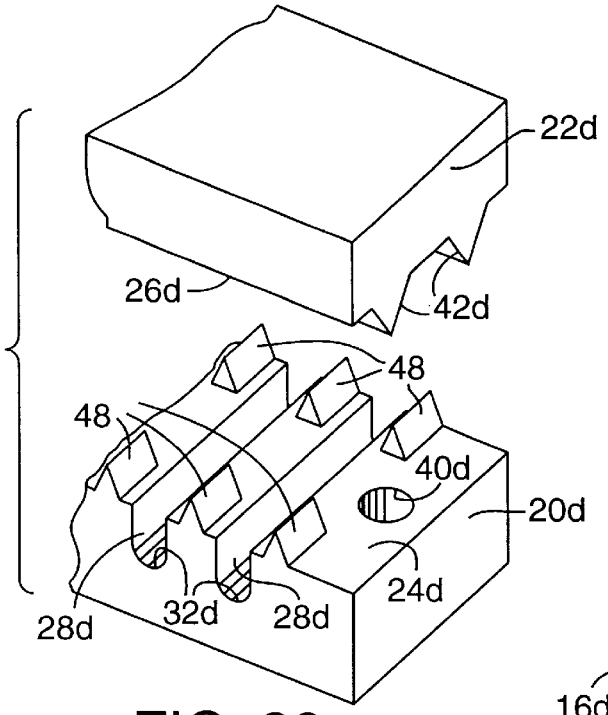
FIG. 20 is a fragmentary perspective view and show the terminal assembly use in practicing the method illustrated in FIG. 19.
Figure 21:
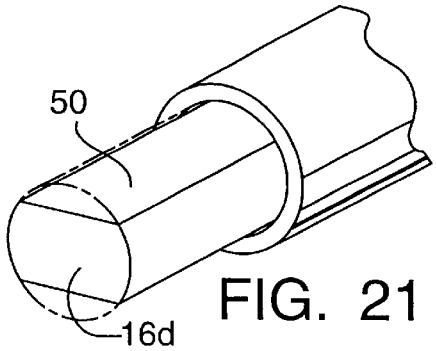
FIG. 21 is a somewhat enlarged fragmentary sectional view showing the end of a solid conductor after a coining operation has been performed thereon.

Referring now to FIG. 19 still another embodiment of the present method is illustrated wherein two solid conductors of circular cross-section and differing hardness are connected to form an electrical junction in accordance with the present method. The two conductors are indicated at 14*d* and 16*d*. The conductor 16*d* is harder of the two conductors. The terminal assembly 18*d* used in forming the connection is similar to the terminal 10, previously described in that it includes a terminal sectional 20*d* and a cap section 22*d* which respectively define confronting surfaces 24*d* and 26*d*. As previously noted, any suitable thermoplastic materials which may be joined by a high frequency vibratory welding process may be employed in practicing the invention. However, where solid conductors are to be connected fiber reinforced plastic material may be preferred. The presently preferred material is a mixture of thermoplastic polymer and reinforcing fiber. A mixture containing not more than thirty percent chopped glass fiber is presently preferred. Referring now to FIG. 20 terminal section 20*d* has an in-line array of conductor receiving slots 28*d*, 28*d* formed therein which extend transversely through it and open upwardly through the surface 24*d*. As in the previously described embodiment 10 each slot 28*d* has an inner end wall 32*d* which complements an associated portion of the softer of the two conductors received therein. However, the terminal section 20*d* has energy directors disposed at opposite sides of each slot which extend in parallel relation to the slot. The energy directors may be formed to extend across the entire transverse width of the terminal section. However, in accordance with the presently preferred construction a pair of transversely spaced apart energy directors 48, 48 are disposed at each side of each slot 28*d*. Each energy director 48 has a generally triangular cross-section and an apex having an included angle of about sixty degrees.

The cap section 22*d* is similar to the previously described cap section 20 and includes a pair of energy directors 42*d*, 42*d* which project from the surface 26*d* and extend longitudinally therealong. Each of the energy directors 42*d*, 42*d* is formed with a generally triangular cross-section having an apex. However, unlike the previously described cap section the included angle formed by the apex of each energy director 42*d* is about sixty degrees.

Figure 22:
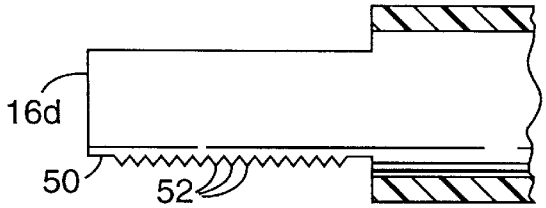
FIG. 22 is a fragmentary side elevational view showing the conductor of FIG. 21 after a serrating operation has been performed thereon.
Figure 23:
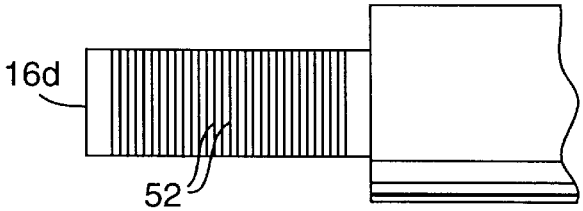
FIG. 23 is a fragmentary bottom plan view of the conductor shown in FIG. 22.

The portion of conductor 16*d* to be received within an associated slot 28 is preferably coined before assembly to increase the area of its contact surface 50, that is the surface which contacts the softer conductor 14*d* within the slot. A multiplicity of preferably saw toothed serrations 52, 52 are preferably coined in and extend transversely of the contact surface 50 as best shown in FIGS. 22 and 23. These serrations are preferably formed by a coining die made by an electric discharge machining (EDC) operation to assure sharp definition. As previously noted, the width of each slot is substantially equal to or slightly greater than the diameter of the soft conductor. The conductors are stacked within the slots with the serrated contact surface of the harder conductor 16*d* contacting the softer conductors 14*d*.

In accordance with the presently preferred method of practicing the invention a force is applied to the conductors 16*d* and 14*d* stacked within the slots 28*d* to cause the serrated contact surface of each hard conductor 16*d* to incise a soft conductor 14*d* and slightly deform it to assure satisfactory electrical contact between the conductors 14*d* and 16*d* before the cap section 22*d* is assembled with the terminal section 20*d*. This procedure enables a force somewhat greater than the required assembly force to be applied to the conductors during this preassembly stage of the process and before the cap section is assembled with the terminal section.

During the final stage of assembly an assembly force in the range from four to eleven pounds is applied to the terminal assembly to move the confronting surfaces toward engagement with each other, a force of about five pounds being presently preferred. While assembly pressure is maintained ultrasonic vibratory energy is applied to the thermoplastic sections causing melting of the coengaging energy directors and associated portions of the confronting surfaces to provide molten material at the interface to bond the sections in assembly. The force brought to bear upon spaced apart portions of the conductors stacked within the slots maintain the conductors in compression during the assembly process. The terminal assembly is maintained under compression after application of ultrasonic vibratory energy has been interrupted allowing the molten material produced by the process to cool securing the conductors in electrically contacting engagement with each other.

Figure 24:
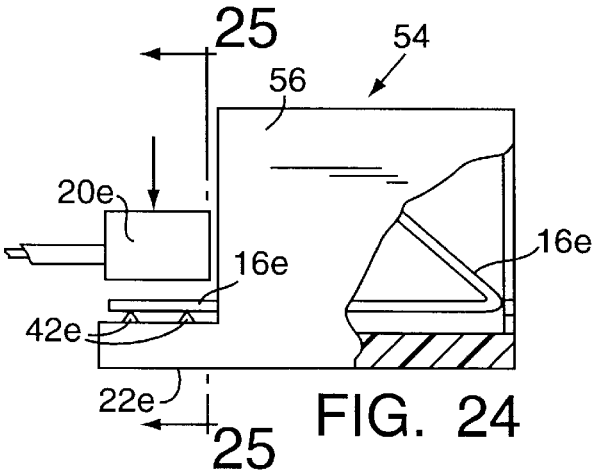
FIG. 24 is a side elevational view illustrating a method for making an electrical component in accordance with the invention and embodying the invention.
Figure 25:
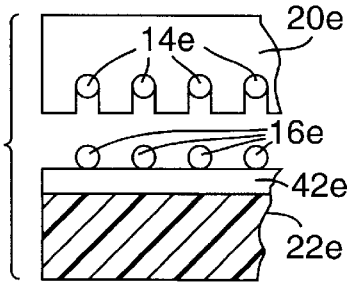
FIG. 25 is a somewhat enlarged fragmentary sectional view taken along the line 25—25 of FIG. 24.

FIGS. 24 and 25 illustrate a method for making an electronic component in accordance with the invention and embodying the invention. The illustrated component indicated generally by the numeral 54 comprises a modified industry standard modular telecommunication connector or jack having a housing 56 made from a suitable thermoplastic material and containing a plurality of conventional cantilever spring wire contacts 16*e*, 16*e*. A cap section 22*e* which generally corresponds to the cap section 22 hereinbefore described is formed with and comprises an integral part of the housing 56. The illustrated cap section 22*e* carries a pair of energy directors 42*e*, 42*e* which, as shown, are disposed immediately below and in contact with extending end portions of the hard wire contacts 16*e*, 16*e*. A terminal section 20*e* which generally corresponds to the previously described terminal section 20 is formed as a separate part for assembly with the cap section 22*e* in accordance with the method of the invention, as previously described.

The jack 54 may also include a means for aligning the sections during assembly, such as the guide posts and apertures hereinbefore described. However, where it may not be possible to integrate the alignment means in the component the alignment means may comprise a part of an assembly jig.

In a component such as the jack 54 wherein the conductors to be connected comprise relatively short hard wire tabs it is generally preferable to form the cap section as an integral part of the component, as aforedescribed. However, in other types of electronic components such as circuit boards, and the like, it may be more convenient for the purpose of assembly to form the terminal section as an integral part of the component.

In FIGS. 24 and 25 the invention is illustrated as practiced with a particular type of electrical connector, however, it should be understood that the invention may be practiced with other types of connectors and electrical components generally wherein one or the other of the terminal assembly sections hereinbefore described comprises an integral part of the component, before assembly, and such constructions are contemplated within the scope of the invention.

I claim:

1. A method for connecting associated portions of electrical conductors in electrically conducting relationship comprising the steps of forming a terminal assembly including separate thermoplastic sections having confronting surfaces, a conductor receiving slot opening outwardly through the confronting surface of one of the sections, and a plurality of elongate spaced apart energy directors projecting from and extending along the confronting surface of another of the sections, stacking in electrical contacting engagement within the slot axially extending portions of a plurality of electrical conductors to be connected forming a stack of axially extending portions in the slot including an axially extending outermost portion projecting outwardly for some distance from the slot and outwardly beyond the confronting surface of the one of the sections, positioning the thermoplastic sections in juxtaposed stacked relationship to each other along the confronting surfaces with the energy directors transversely bridging the slot and extending across and engaging the axially extending outermost portion, applying compressive force to the thermoplastic sections urging the confronting surfaces toward engagement with each other and causing the energy directors to bear upon the outermost portion applying compressive force at axially spaced apart locations to the stack, applying high frequency vibratory energy to the sections melting the thermoplastic energy directors and the thermoplastic surfaces engaged by the energy directors and allowing molten thermoplastic material to flow into the slot filling voids therein, and ceasing application of high frequency vibratory energy when the confronting surfaces move into engagement and while the sections are maintained under compression allowing the molten thermoplastic material to solidify welding the sections in assembly with each other and encapsulating in thermoplastic material axially extending portions in electrical contacting engagement with each other.

2. A method for connecting associated portions of electrical conductors as set forth in claim 1 wherein the step of applying high frequency vibratory energy is further characterized as applying ultrasonic vibratory energy.

3. A method for connecting associated portions of electrical conductors as set forth in claim 1 wherein the step of forming is further characterized as forming each of the energy directors with a generally triangular cross-section.

4. A method for connecting associated portions of electrical conductors as set forth in claim 3 wherein the step of forming is further characterized as forming the triangular cross-section of each of the energy directors with an apex having an included angle of about 90 degrees.

5. A method for connecting associated portions of electrical conductors as set forth in claim 1 wherein the conductor receiving slot has an inner end wall and said step of forming is further characterized as forming the inner end wall of the conductor receiving slot to substantially complement an associated portion of a conductor axially extending portion received within the slot and engaging the inner end wall.

6. A method for connecting associated portions of electrical conductors as set forth in claim 5 wherein the step of forming is further characterized as forming the width of the conductor receiving slot to substantially equal the width of an associated conductor axially extending portion received within the slot.

7. A method for connecting associated portions of electrical conductors as set forth in claim 1 including the step of producing a fiber reinforced ultrasonically weldable material comprising a thermoplastic polymer and a reinforcing fiber and the step of forming is further characterized as forming at least one of the sections from the fiber reinforced ultrasonically weldable material.

8. A method for connecting associated portions of electrical conductors as set forth in claim 7 wherein the step of producing is further characterized as producing a mixture comprising the thermoplastic polymer and the reinforcing fiber.

9. A method for connecting associated portions of electrical connectors as set forth in claim 7 wherein the step of producing is further characterized as producing a mixture comprising the thermoplastic polymer and chopped glass fiber and forming said at least one of the sections from the mixture.

10. A method for connecting associated portions of electrical conductors as set forth in claim 1 including the step of determining the compressibility factor of at least one of the conductors and the step of forming is further characterized as forming the slot with a depth substantially equal to the height dimension of the stack less the compressibility factor of the one conductor.

11. A method for connecting associated portions of electrical conductors as set forth in claim 10 wherein the step of determining the compressibility factor comprises providing a test material defining a test slot having a slot width substantially equal to the nominal diameter of the one conductor and an inner end substantially complementing an associated portion of the one conductor, positioning the one conductor within the test slot, applying to the one conductor within the test slot a test force substantially equal to the compressive force, and determining the change in dimension of the one conductor in the direction of the applied test force.

12. A method for connecting associated portions of electrical conductors as set forth in claim 11 wherein the compressibility factor of the one conductor is greater than the compressibility factor of another of the conductors and the step of stacking is further characterized as stacking the conductors with the one conductor disposed at the bottom of the stack.

13. A method for connecting associated portions of electrical conductors as set forth in claim 1 wherein the step of applying compressive force is further characterized as applying compressive force within a range from four to eleven pounds.

14. A method for connecting associated portions of electrical conductors as set forth in claim 1 wherein the step of applying compressive force is further characterized as applying a compressive force of about five pounds.

15. A method for connecting associated portions of electrical conductors as set forth in claim 1 wherein the step of forming is further characterized as forming said another of the sections with additional energy directors projecting therefrom at opposite sides of the slot and extending in generally parallel relation to the direction of slot extent.

16. A method for connecting associated portions of electrical conductors as set forth in claim 15 wherein each of the energy directors has a generally triangular cross-section and an apex having an included angle of about sixty degrees.

17. A method for connecting associated portions of electrical conductors as set forth in claim 1 wherein at least one of the conductors comprises an axially elongate insulated conductor and the method includes the step of stripping insulation from the at least one conductor in axially spaced relation to the ends of the at least one conductor to expose an uninsulated portion of the at least one conductor and the step of stacking is further characterized as stacking the axially extending portions including the uninsulated portion in electrical contacting engagement within the slot.

18. A method for connecting associated portions of electrical conductors as set forth in claim 17 wherein the step of forming is further characterized as forming an outwardly open groove in the one of the sections intersecting and opening into the slot and the method includes the step of positioning a part of the uninsulated portion within the groove.

19. A method for connecting associated portions of electrical conductors as set forth in claim 1 wherein the conductors include a solid conductor having an arcuate surface configuration, the method includes the step of coining a portion of the solid conductor to flatten an axially extending portion of the arcuate surface, and the step of stacking is further characterized as stacking the axially extending portions including the axially extending flattened portion of the solid conductor within the slot.

20. A method for connecting associated portions of electrical conductors as set forth in claim 19 wherein the step of coining includes forming a multiplicity of serrations on the flattened portion.

21. A method for connecting associated portions of electrical conductors as set forth in claim 1 wherein the method includes the additional step of supporting the one of the sections in a fixture mounted on an ultrasonic welding machine, the step of applying compressive force is further characterized as applying compressive force with a horn of the ultrasonic welding machine, and the step of applying high frequency vibratory energy is further characterized as applying ultrasonic vibratory energy to the sections with the horn.

22. A method for connecting associated portions of electrical conductors in electrical conducting relationship as set forth in claim 1 wherein at least one of the conductors comprises a stranded wire conductor and wherein the step of stacking is further characterized as forming the stack with the axially extending portion of the at least one stranded wire conductor at the bottom of the stack.

23. A method for connecting associated portions of electrical conductors in electrically conducting relationship as set forth in claim 1 wherein the conductors are of differing hardness and the step of stacking is further characterized as forming the stack with the axially extending portion of the softer of the conductors at the bottom of the stack.

24. A method for making an in-line array of electrical connections comprising the steps of forming a terminal assembly including thermoplastic sections having confronting surfaces, an in-line series of conductor receiving slots opening through the confronting surface of one of the sections, and elongate spaced apart energy directors projecting from and extending along the confronting surface of another of the sections, stacking in each of the slots portions of a plurality of associated electrical conductors to be connected and including an outermost conductor having a part thereof exposed externally of the slot, positioning the one and the other thermoplastic sections in juxtaposed stacked relationship to each other along the confronting surfaces with the energy directors extending across the slots in axially transverse relationship to and in engagement with the exposed part of each of the outermost conductors stacked within the slots, applying compressive force to the thermoplastic sections urging the confronting surfaces toward engagement with each other and causing the energy directors to apply compressive force to the outermost conductors stacked within the slots, applying high frequency vibratory energy to the sections to melt the thermoplastic energy directors and the thermoplastic surfaces engaged by the energy directors to provide molten thermoplastic material at the interface between the confronting surfaces and at the slots while the sections are maintained under compression, and ceasing the application of high frequency vibratory energy to the sections while the sections are maintained under pressure allowing the molten thermoplastic material to solidify forming a weld bonding the confronting surfaces in assembly and at least partially encapsulating the resulting electrical connections within the slots.

25. A method for making an in-line array of electrical connections as set forth in claim 24 wherein the step of forming is further characterized as forming adjacent slots in said array to provide a barrier therebetween and forming the width of each adjacent slot to exceed the width of the barrier.

26. A method for connecting associated axially extending portions of electrical conductors in electrically conducting relationship to each other comprising the steps of forming a terminal assembly including separate thermoplastic sections having confronting surfaces and a conductor receiving slot opening outwardly through the confronting surface of one of the sections and having an inner end wall for substantially complementing an undeformed axially extending portion of an associated conductor received within said slot and a plurality of elongate spaced apart energy directors projecting from and extending along the confronting surface of another of the sections, stacking in electrical contacting engagement within the slot axially extending portions of a plurality of electrical conductors to be connected, positioning the thermoplastic sections in juxtaposed stacked relationship to each other along the confronting surfaces with the energy directors extending across the slot in axially transverse relationship to the stacked conductors supported within the slot, applying compressive force to the thermoplastic sections to urge the confronting surfaces toward engagement with each other causing the energy directors to apply compressive force at axially spaced apart locations to the stacked conductors supported within the slot, applying high frequency vibratory energy to the sections to soften the thermoplastic energy directors and the thermoplastic surfaces engaged by the energy directors to provide molten thermoplastic material at the interface between the confronting surfaces while the sections are maintained under compression, and ceasing application of high frequency vibratory energy while maintaining the sections under compression allowing the molten thermoplastic material to solidify to integrally join the sections in assembly generally along said confronting surfaces and at least partially encapsulate coengaging axially extending portions of the conductors.

27. A method for connecting associated portions of electrical conductors in electrically conducting relationship, at least one of the conductors being an axially elongate insulated conductor, said method comprising the steps of forming terminal assembly including separate thermoplastic sections having confronting surfaces and a conductor receiving slot opening through the confronting surface of one of the sections, an outwardly open groove in the one of the sections intersecting and opening into the slot, and a plurality of elongate spaced apart energy directors projecting from and extending along the confronting surface of another of the sections, stripping insulation from the one conductor in axially spaced relation to the ends of the one conductor to expose an axially extending portion of the one conductor, stacking in electrical contacting engagement within the slot axially extending portions of a plurality of electrical conductors to be connected and including the exposed axially extending portion of the one conductor, positioning a part of the exposed axially extending portion within the groove and the thermoplastic sections in juxtaposed stacked relationship to each other along the confronting surfaces with the energy directors extending across the slot in axially transverse relationship to the stacked conductors supported within the slot, applying compressive force to the thermoplastic sections to urge the confronting surfaces toward engagement with each other and cause the energy directors to apply compressive force at axially spaced apart locations to the stacked conductors supported within the slot, applying high frequency vibratory energy to the sections to soften the thermoplastic energy directors and the thermoplastic surfaces engaged by the energy directors to provide molten thermoplastic material at the interface between the sections, and ceasing application of high frequency vibratory energy while the sections are maintained under compression to allow the molten thermoplastic material to solidify to integrally join the sections in assembly with each other.

28. A method for connecting associated portions of electrical conductors as set forth in claim 27 wherein the step of positioning is further characterized as bending the one conductor to position the part thereof within the groove.

29. A method for connecting associated portions of electrical conductors in electrically conducting relationship comprising the steps of determining the compressibility factor of at least one of the conductors, forming a terminal assembly including separate thermoplastic sections having confronting surfaces, forming a conductor receiving slot opening through the confronting surface of one of the sections and a plurality of elongate spaced apart energy directors projecting from and extending along the confronting surface of another of the sections, stacking in electrical contacting engagement within the slot axially extending portions of a plurality of electrical conductors to be connected, forming the slot with a depth substantially equal to the height dimension of the stacked conductors less the compressibility factor of the one conductor, positioning the thermoplastic sections in juxtaposed stacked relationship to each other along the confronting surfaces with the energy directors extending across the slot in axially transverse relationship to the stacked conductors supported within the slot, applying compressive force to the thermoplastic sections to urge the confronting surfaces toward engagement with each other and cause the energy directors to apply compressive force at axially spaced apart locations to the stacked conductors supported within the slot, applying high frequency vibratory energy to the sections to melt the thermoplastic energy directors and the thermoplastic surfaces engaged by the energy directors to provide molten thermoplastic material at the interface between the sections, and ceasing application of high frequency vibratory energy while the sections are maintained under compression to allow the molten thermoplastic material to solidify to integrally join the sections in assembly with each other.

30. A method for connecting associated portions of electrical conductors as set forth in claim 29 wherein the step of determining the compressibility factor comprises providing a test material defining a test slot having a slot width substantially equal to the nominal diameter of the one conductor and an inner end substantially complementing an associated portion of the one conductor, positioning the one conductor within the test slot, applying to the one conductor within the test slot a test force substantially equal to the compressive force, and determining the change in dimension of the one conductor in the direction of the applied test force.

31. A method for making a high density in-line array of electrical connections comprising the steps of forming an elongate longitudinally extending terminal assembly including separate thermoplastic sections having confronting surfaces, a longitudinally extending in-line array of electrical conductor receiving slots opening outwardly through the confronting surface of one of the sections, and a plurality of integral longitudinally extending and transversely spaced apart energy directors projecting from the confronting surface of another of said sections, stacking in electrical contacting engagement with each other and within the slots axially extending portions of electrical conductors to be connected to form an in-line array of stacks of electrical conductors within the slots, each of the stacks including an outermost axially extending portion projecting outwardly for some distance from its associated slot and outwardly beyond the confronting surface of the one of the sections, positioning the thermoplastic sections in juxtaposed stacked relationship to each other along the confronting surfaces with the energy directors bridging the slots and extending across and in engagement with the axially extending outermost portion of each of the stacks, applying compressive force to the thermoplastic sections to urge the confronting surfaces toward engagement with each other bringing the energy directors to bear upon the outermost axially extending portion of each of the stacks and applying compressive force at axially spaced apart locations to the stacks and applying high frequency vibratory energy to the sections while the sections are maintained under compression to substantially melt the thermoplastic energy directors including the portions of the energy directors bridging the slots and the thermoplastic surfaces engaged by the energy directors welding the interface between the sections and allowing molten thermoplastic material to flow into the slots encapsulating coengaging axially extending portions of the conductors within the slots.

32. A method for connecting associated portions of axially elongated electrical conductors in electrically conducting relationship, the conductors including a first solid conductor having an axially extending arcuate peripheral surface, said method comprising the steps of forming a terminal assembly including separate thermoplastic sections having confronting surfaces, a conductor receiving slot opening through the confronting surface of one of the sections, and a plurality of elongate spaced apart energy directors projecting from and extending along the confronting surface of another of the sections, coining a portion of the peripheral surface of the first solid conductor to form an axially extending flattened peripheral portion, stacking in electrical contacting engagement within the slot axially extending portions of a plurality of electrical conductors to be connected including the axially extending flattened peripheral portion, the step of coining to be performed before the step of stacking, positioning the thermoplastic sections in juxtaposed stacked relationship to each other along the confronting surfaces with the energy directors extending across the slot in axially transverse relationship to the stacked conductors supported within the slot, applying assembly force to the thermoplastic sections to urge the confronting surface toward engagement with each other and cause the energy directors to apply compressive force at axially spaced apart locations to the stacked conductors supported within the slot, applying high frequency vibratory energy to the sections to melt the thermoplastic energy directors and the thermoplastic surfaces engaged by the energy directors to provide molten thermoplastic material at the interface between the sections, and ceasing application of high frequency vibratory energy while the sections are maintained under compression to allow the molten thermoplastic material to solidify to integrally join the sections in assembly with each other.

33. A method for connecting associated portions of axially elongated electrical conductors as set forth in claim 32 wherein the conductors include a second solid conductor, the first solid conductor is harder than the second solid conductor, and the step of stacking further comprises stacking the axially extending flattened peripheral portion of the first conductor in engagement with an axially extending peripheral portion of the second conductor within the slot.

34. A method for connecting portions of axially elongated electrical conductors as set forth in claim 33 wherein the step of coining is further characterized as forming serrations on the axially extending flattened peripheral portion of the first conductor.

35. A method for connecting portions of axially elongated electrical conductors as set forth in claim 34 including the additional step of applying a preassembly force greater than the assembly force to the conductors stacked within the slot causing incising of the second conductor by the serrations on the first conductor, the step of applying preassembly force to be performed before the step of positioning.

* * * * *